US006616355B2

(12) United States Patent
Cleary et al.

(10) Patent No.: US 6,616,355 B2
(45) Date of Patent: Sep. 9, 2003

(54) PRINTING SYSTEM FOR ACCOMMODATING VARIOUS SUBSTRATE THICKNESSES

(75) Inventors: Arthur L. Cleary, Center Harbor, NH (US); Joseph A. Lahut, Center Harbor, NH (US); Rainer Rall, Belmont, NH (US); Paul Duncanson, Franklin, NH (US)

(73) Assignee: VUTEK, Inc., Meredith, NH (US)

( * ) Notice: Subject to any disclaimer, the term of this patent is extended or adjusted under 35 U.S.C. 154(b) by 0 days.

(21) Appl. No.: 10/055,630

(22) Filed: Oct. 29, 2001

(65) Prior Publication Data

US 2002/0159815 A1 Oct. 31, 2002

Related U.S. Application Data

(60) Provisional application No. 60/244,358, filed on Oct. 30, 2000.

(51) Int. Cl.[7] ..... B41J 11/20

(52) U.S. Cl. ..... 400/56; 400/55

(58) Field of Search ..... 400/55–60

(56) References Cited

U.S. PATENT DOCUMENTS

| | | | | |
|---|---|---|---|---|
| 4,917,512 A | | 4/1990 | Mimura et al. | 400/56 |
| 5,118,209 A | | 6/1992 | Bennet et al. | 400/56 |
| 5,204,537 A | | 4/1993 | Bennet et al. | 250/560 |
| 5,382,104 A | | 1/1995 | Hirono et al. | 400/608.2 |
| 5,468,076 A | * | 11/1995 | Hirano et al. | 347/8 |
| 5,518,323 A | * | 5/1996 | Sakaino et al. | 400/124.04 |
| 5,518,324 A | * | 5/1996 | Campbell et al. | 400/56 |
| 5,610,636 A | | 3/1997 | Hanabusa et al. | 347/8 |
| 5,704,721 A | | 1/1998 | Ikehata et al. | 400/55 |
| 5,806,992 A | * | 9/1998 | Ju | 250/559.27 |
| 6,215,552 B1 | | 4/2001 | Acquaviva et al. | 356/371 |
| 6,406,110 B1 | * | 6/2002 | Ahne et al. | 347/8 |

* cited by examiner

*Primary Examiner*—Charles H. Nolan, Jr.
(74) *Attorney, Agent, or Firm*—Hamilton, Brook, Smith & Reynolds, P.C.

(57) ABSTRACT

A system for printing images on a substrate includes a multiplicity of print heads mounted in a carriage and positioned a distance from the substrate. A sensor detects the thickness of the substrate as the substrate moves through the system, and a control system receives the substrate thickness information detected by the sensor and transmits signals to a motor coupled to the carriage. These signals instruct the motor to adjust the position of the carriage to maintain a desired gap between the print heads and the substrate.

18 Claims, 6 Drawing Sheets

PRINTING SYSTEM FOR ACCOMMODATING VARIOUS SUBSTRATE THICKNESSES

RELATED APPLICATION

This application claims the benefit of U.S. Provisional Application No. 60/244,358, filed on Oct. 30, 2000. The entire teachings of the above application are incorporated herein by reference.

BACKGROUND

Certain types of printing systems are adapted for printing images on large-scale substrates, such as museum displays, billboards, sails, bus boards, and banners. Some of these systems use so-called drop on demand ink jet printing. In these systems, a piezoelectric vibrator applies pressure to an ink reservoir of the print head to force the ink out through the nozzle orifices positioned on the underside of the print heads. A particular image is created by controlling the order at which ink is ejected from the various nozzle orifices.

In some of these systems, a carriage which holds a set of print heads scans across the width of a flexible substrate while the print heads deposit ink as the substrate moves. In another type of system, a solid, non-flexible substrate is supported on a table. The carriage holding the print heads has two degrees of motion so that it is able to move along the length as well as the width of the substrate as the print heads deposit ink onto the substrate. And in yet another arrangement, a solid, non-flexible substrate is held to a table as the entire table and substrate move together s along one axis of the substrate under the print heads as the carriage holding the print heads traverses in a direction normal to that axis while the print heads deposit ink to create a desired image.

SUMMARY

To print on solid, non-flexible substrates, operators typically first print on a flexible substrate and then laminate the substrate onto a solid, non-flexible base. As for printing systems that print directly only solid substrates, the size of the substrate upon which the image can be printed is limited. For example, a carriage with two-degrees of motion can only travel to the extent of the physical dimensions of the rails along which the carriage travels. As for systems in which the table along with the substrate moves under the print heads, the substrate can be no larger that the size of the table. It is desirable therefore to be able to print on both flexible and non-flexible substrates with varying thicknesses, and to be able to accommodate substrates with various stiffnesses and thicknesses automatically with little or no intervention from the operator.

In one aspect of the invention, a system for printing images on a substrate includes a multiplicity of print heads mounted in a carriage and positioned a distance from the substrate. A sensor detects the thickness of the substrate as the substrate moves through the system, and a control system receives the substrate thickness information detected by the sensor and transmits signals to a motor coupled to the carriage. These signals instruct the motor to adjust the position of the carriage to maintain a desired gap between the print heads and the substrate. The minimum gap can be about 0.04 inch, and the maximum gap can be about 0.08 inch.

Embodiments of this aspect can include one or more of the following features. The control system includes a controller which transmits the signals to the motor. The controller is coupled to a CPU which receives a substrate thickness information signal from the sensor, processes the information, and transmits signals to the controller to instruct the motor to adjust the position of the carriage to maintain the desired gap. The control system includes a feedback device which senses the gap between the print heads and the substrate. The gap information is relayed to the controller such that the controller can further instruct the motor to alter the position of the print heads relative to the substrate to achieve the desired gap. In certain embodiments, the feedback device transmits the gap information to a CPU which processes the information and relays the processed gap information to the controller. The motor can be a servo motor.

In some embodiments, the position of the carriage is adjusted in less than about five seconds. The sensor can include an indicator roller, and a dial indicator can be coupled to the indicator roller.

A related aspect of the invention includes a method for controlling the distance between print heads of a printing system and a substrate. The method includes detecting the thickness of the substrate, and transmitting the thickness information to a controller. The controller transmits height adjustment information to a motor coupled to a carriage which holds the print heads. The motor then adjusts the position of the carriage to maintain a desired gap between the print heads and the substrate.

The method can include detecting the distance between the substrate and the print heads, and the position of the print heads can be re-adjusted based on the distance information. The gap maintained between the print heads and the substrate can be approximately in the range 0.04 inch to 0.08 inch.

Among other advantages, the printing system of the present invention is capable of printing on both flexible and non-flexible substrates without manually adjusting the gap between the print heads and the substrate.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
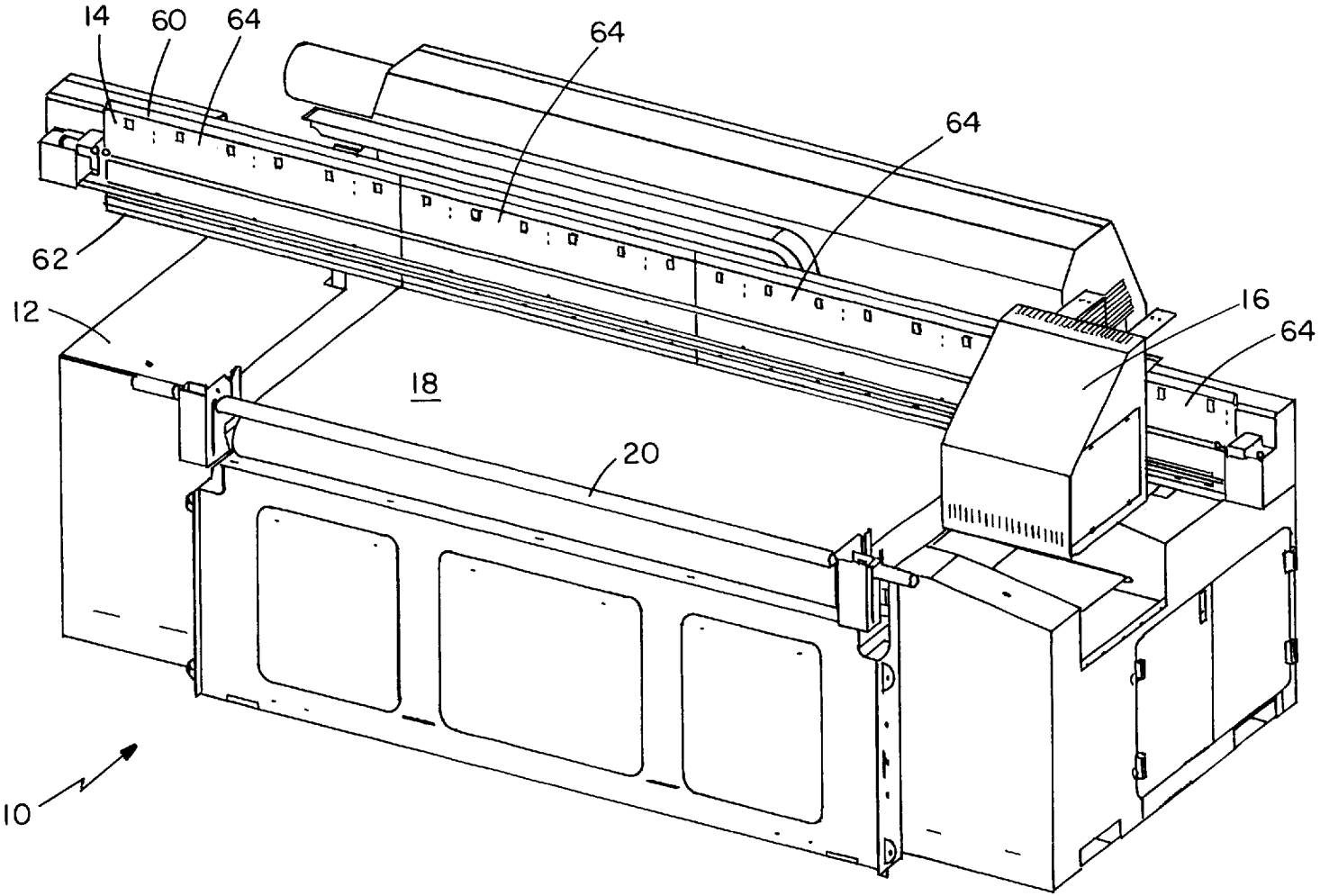
FIG. 1 is an perspective view of a printing system in accordance with the present invention.

Referring to FIG. 1, there is shown a printing system 10 that prints on both flexible and non-flexible substrates. Further, the printing system 10 is able to accommodate substrates with various thickness automatically during the printing process.

The printing system 10 includes a base 12, a rail system 14 attached to the base 12, a transport belt 18 which moves a substrate though the system, and a substrate thickness indicator roller 20. A carriage 16 holding a set of print heads 17 (shown in phantom) is supported by and traverses along the rail system 14.

Figure 2A:
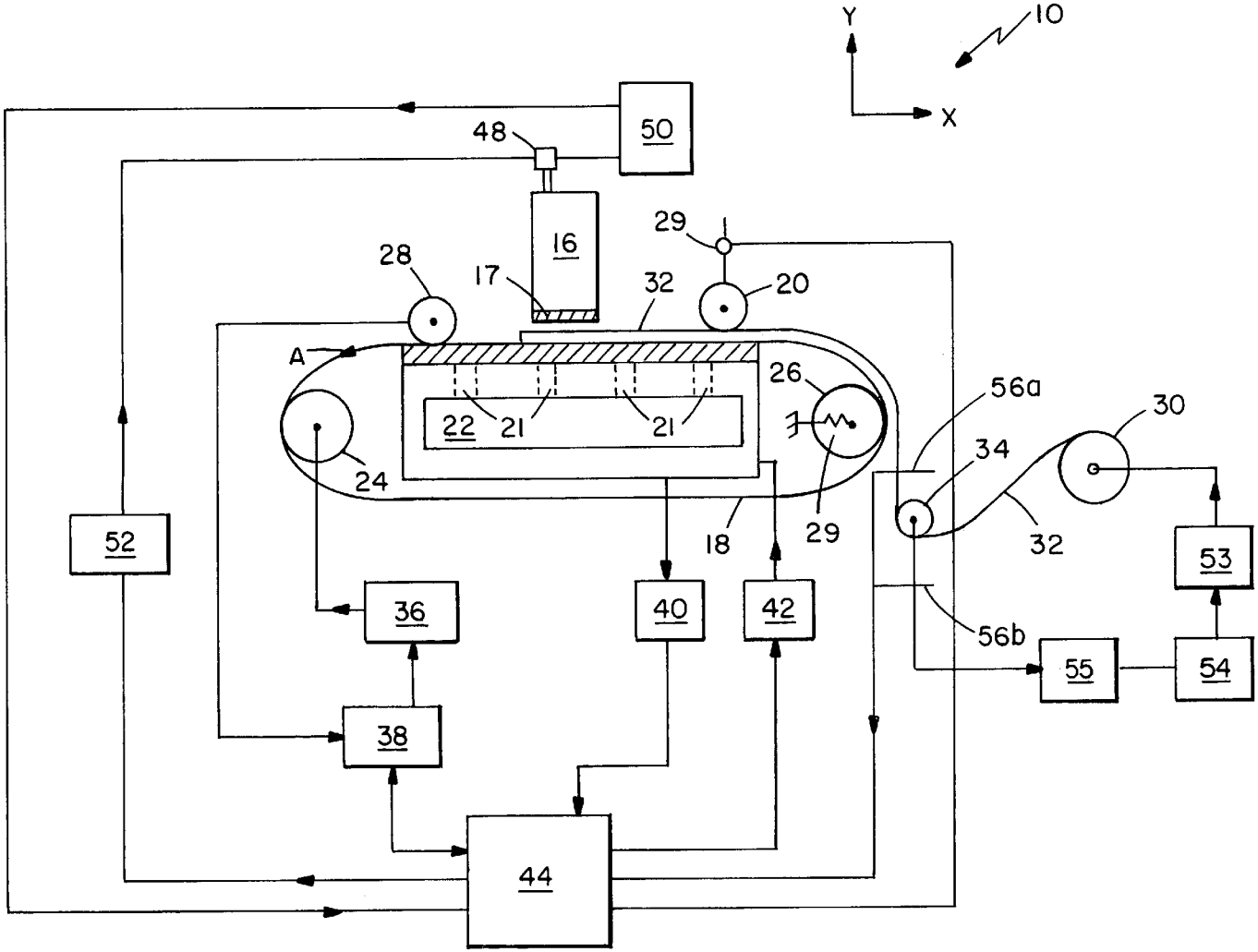
FIG. 2A is a cross-sectional and block diagram view of the printing system of FIG. 1.
Figure 2B:
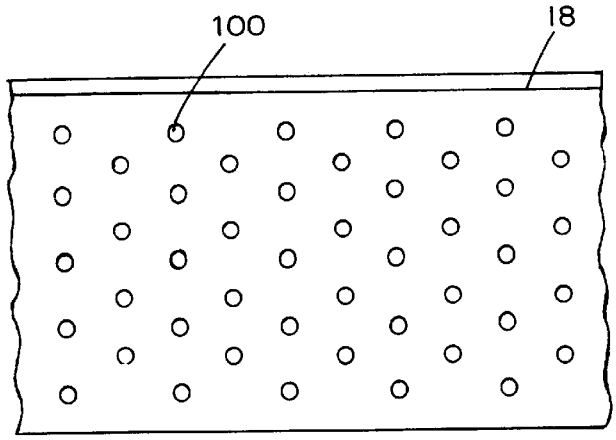
FIG. 2B is a top view of a transport belt of the printing system of FIG. 1.

Referring further to FIG. 2, the set of print heads 17 which are typically positioned from about 0.04 inch to about 0.08 inch from a substrate 32 as the substrate moves through the system by the transport belt 18. A carriage motor 48 such as, for example, a servo motor or any other suitable drive mechanism, of the carriage 16 is connected to a feedback device 50 and a carriage motor controller 52. The motor controller 52 as well as the feedback device 50 transmit signals to a controller such as a central CPU 44.

As mentioned above, the printing system 10 is able to automatically accommodate changes in the thickness of the substrate. For example, if the thickness of the substrate increases or if the substrate is thicker than the previous substrate, as the substrate moves through the system, the indicator roller 20 which sits on top of the substrate rises. The increased thickness is detected in turn by a dial indicator 29 that is attached to the indicator roller 20. This increased thickness information is transmitted from the dial indicator 29 to the CPU 44. The CPU 44 then transmits a signal to the controller 52 to instruct the carriage motor 48 to move carriage 16 and hence the print heads 17 upwards away from the substrate. Meanwhile, the position of the carriage is relayed to the feedback device 50 and in turn to the CPU 44 which then determines if further finer adjustments are needed to position print heads 17 at the proper height. Thus regardless of the thickness and/or stiffness of the substrate, the printing system 10 maintains a precise desired gap between the print heads 17 and the substrate 32. The printing system 10 is able to automatically accommodate a change in thickness of the substrate in about five seconds. In sum, the printing system 10 is capable of handling flexible substrates as well as solid non-flexing substrates with various thicknesses "on the fly" with minimal or no intervention from an operator.

To prevent the substrate from slipping on the transport belt 18, the printing system 10 also includes a vacuum table 22 provided with a set of holes 21. A vacuum motor 42 supplies the vacuum to the vacuum table 22, and the vacuum is detected by a vacuum sensor 40. Both the vacuum sensor 40 and the vacuum motor 42 are connected to and under the direction of the CPU 44 which receives and transmits the appropriate signals to maintain the desired vacuum. In the illustrated embodiment, the vacuum provided by the vacuum table 22 is approximately in the range −0.05 psi to −0.3 psi.

The transport belt 18 is provided with holes 100 (FIG. 2B) that extend through the thickness of the belt, each having a diameter of about 0.1 inch, which are spaced apart from one another by about one inch. The belt 18 is a woven polyester made from reinforced polyurethane, and has a thickness of about 0.09 inch. The woven polyester minimizes stretching of the belt 18 and thus provides high stepping accuracy and uniform vacuum distribution. Alternatively, the belt can be made from stainless steel having a thickness of about 0.008 inch.

A porous sheet 43 having a thickness of about 0.5 inch sits between the vacuum table 22 and the transport belt 18. The porous sheet is made from a sintered, porous polyethylene, or any other suitable material. The holes in the belt 18, and the porous sheet 43 assure that a suction is applied to a substrate when a vacuum is provided by the vacuum table 22. In essence, the porous sheet 43 acts as a flow resistor. Thus when the substrate covers only a portion of belt 18, the vacuum provided by the vacuum table 22 does not have to be significantly readjusted, if at all, even as the area over the belt covered by the substrate varies. In sum, with the porous sheet 43, a continuous vacuum can be provided by the vacuum table 22, and no further adjustment to the vacuum level needs to be made as one or more substrates are transmitted through the printing system during the print process. This feature is applicable to both continuous substrates, for example, those supplied from a roll, as well as non-continuous substrates such as a flexible or a rigid sheet supplied individually.

Turning now to the drive mechanism of the printing system 10, the transport belt 18 wraps around a drive roller 24 and an idler roller 26, while an optical encoder wheel 28 and the thickness indicator roller 20 sits on top the belt 18. The idler roller 26 is able to move in the x-direction and through a dynamic tensioning device 29 keeps the belt 18 under a constant tension during the printing process.

A drive motor 36 rotates the drive roller 24 which causes the belt 18 to move in the direction of arrow A, and is connected along with the encoder wheel 28 to a drive controller 38. The encoder wheel 28 detects the precise distance that the substrate moves. This information is relayed to the drive controller 38 and in turn to the CPU 44. The CPU 44 transmits a signal back to the controller 38 which controls the speed of the drive motor 36 so that the distance the substrate moves is precisely controlled. Thus the feedback position signals from the optical encoder 28 compensates for belt thickness variations, seams in the belt, and variations in the diameter of the rollers over time.

In some embodiments, the feed wheel 30 supplies a flexible substrate 32, which wraps underneath a dancer roller 34, to the printing system. The feed wheel 30 is rotated by a feed motor 53 which is controlled by a feed controller 54. Both the feed controller 54 and the dancer 34 are connected to a position sensor 55, and located above and below the dancer 34 is a top limit switch **56*a* and a bottom limit switch 56*b***, respectively.

If during the printing process a jam occurs, the dancer 34 will rise and trigger the top switch **56*a* to send a signal to the central CPU 44 which then directs the printing system 10 to terminate the printing process because a problem has been detected. And if the feed roll 30 becomes depleted of the substrate material 32 during the printing process, the dancer 34 will drop down and trigger the bottom switch 56*b* to transmit a signal to the CPU 44** to shut the printing process off since there is no longer any substrate material.

During the printing process, as the substrate 32 is fed by the feed wheel 30, the position sensor 55 detects the height of the dancer 34. This height information is transmitted to the feed controller 54 which in turn adjusts the power to the feed motor 53 to increase or reduce the feed speed, or to reverse the feed direction of feed wheel 30 such that a constant tension is maintained in the substrate. A constant tension is desired to maintain positional accuracy of the substrate and to remove any wrinkles in the substrate while it moves through the printing system.

Figure 3A:
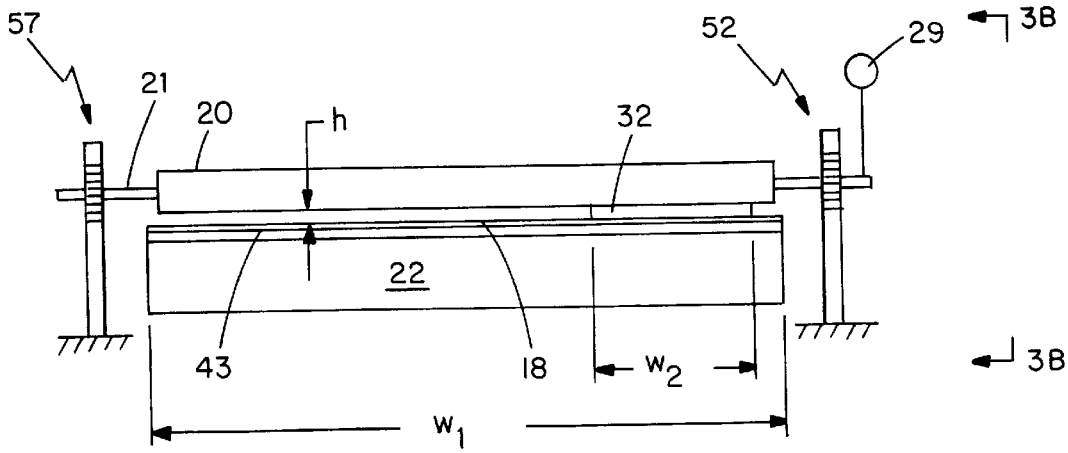
FIG. 3A is an isolated view of a thickness indicator roller of the printing system of FIG. 1.
Figure 3B:
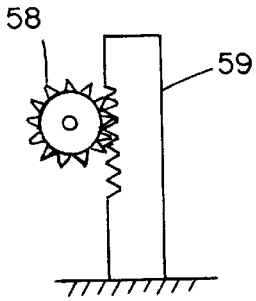
FIG. 3B is a side view of the thickness roller along the line 3B—3B of FIG. 3A.

The printing system 10 can detect thickness variations of the substrate regardless of the width of the substrate or the position of the substrate relative to the width of belt 18. This capability is illustrated in FIGS. 3A and 3B. As shown, the thickness indicator roller 20 rotates freely about a bar 21 that is supported by a pair of ratchet/gear mechanisms 57, each of which includes a gear 58 engaged with a rachet 59. Thus when a substrate causes the height of indicator roller 20 to vary, both of the gears 58 rotate so that the indicator roller 20 is at the same height, "h", along the width, "$w_1$", of the belt 18 regardless of the width, "$w_2$", of the substrate 32 that is fed to the printer system. Note that the vertical position, "y", of the dancer 34 (FIG. 2) is also controlled by a similar ratchet/gear mechanism. Alternatively, a laser triangulation device is used to determine the thickness of the substrate.

Figure 4A:
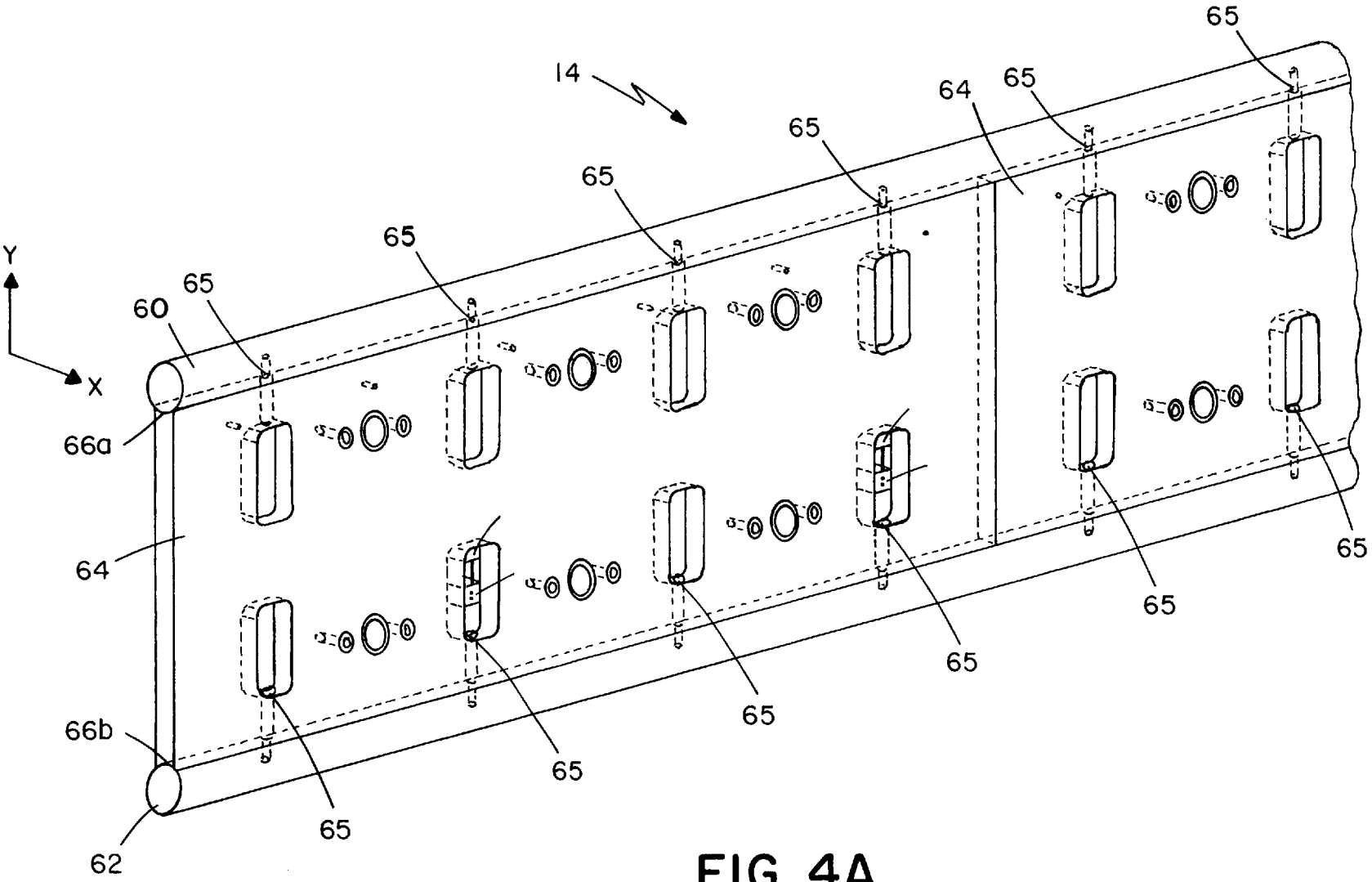
FIG. 4A is an isometric view of a part of a rail system for supporting a carriage of the printing system of FIG. 1.
Figure 4B:
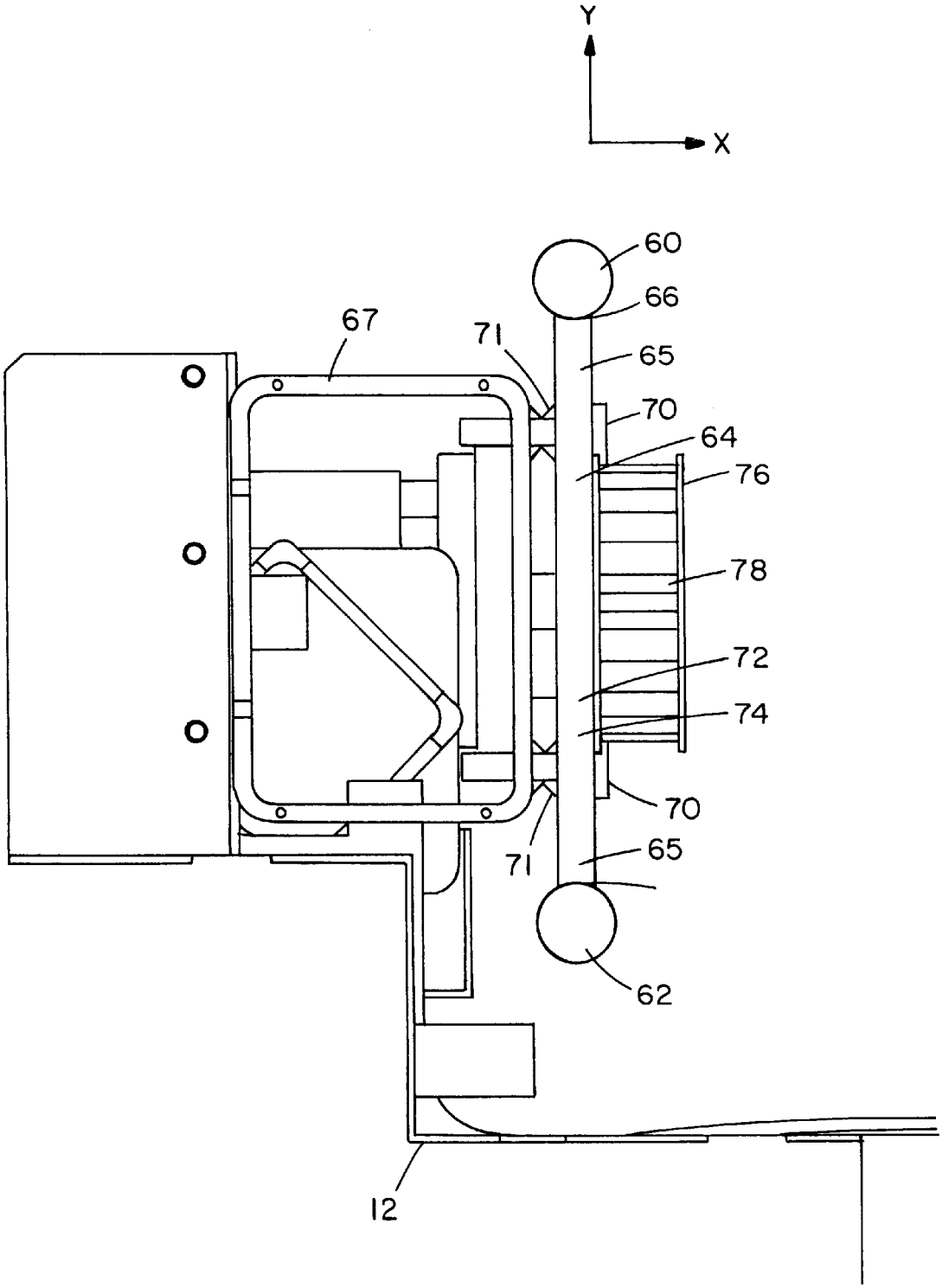
FIG. 4B is a cross-sectional view of the rail system of FIG. 4A shown mounted to a support beam.

Referring now to FIGS. 4A and 4B, the rail system 14 includes a top rail 60 and a bottom rail 62. These rails are attached to a set of spacer support plates 64 by a set of screws 65 along a bottom and a top machined V-groove 66*a* and 66*b,* respectively. These grooves 66 provide a two-point contact with each of the rails 60 and 62. This two-point contact is maintained along the entire length of the rails 60 and 62. The set of support plates 64 is attached to a support beam 67 of the base 12 by a series of set screws 68. The horizontal displacement, "x", of the support plates 64 with respect to the support beam 66 is adjusted by a set of horizontal jack screws 70. Each horizontal jack screw 70 is associated with a bellvile washer 71 that pushes the support plates 64 away from the support beam 66 to assure that the horizontal jack screws 70 are always under tension. The vertical position, "y", of the support plates 64 is adjusted by a set of vertical jack screws 72. The vertical jack screws 72 are threaded into a block 74 that is attached to the support beam 67. The machined V-grooves 66, and the jack screws 70 and 72 enable an operator to adjust the position of the rails 60 and 62 so that the rails remain parallel in a plane and parallel to one another to within a tolerance of about ±0.0005 inch which ensures the precise positioning of the print heads 17 relative to substrate.

Figure 4C:
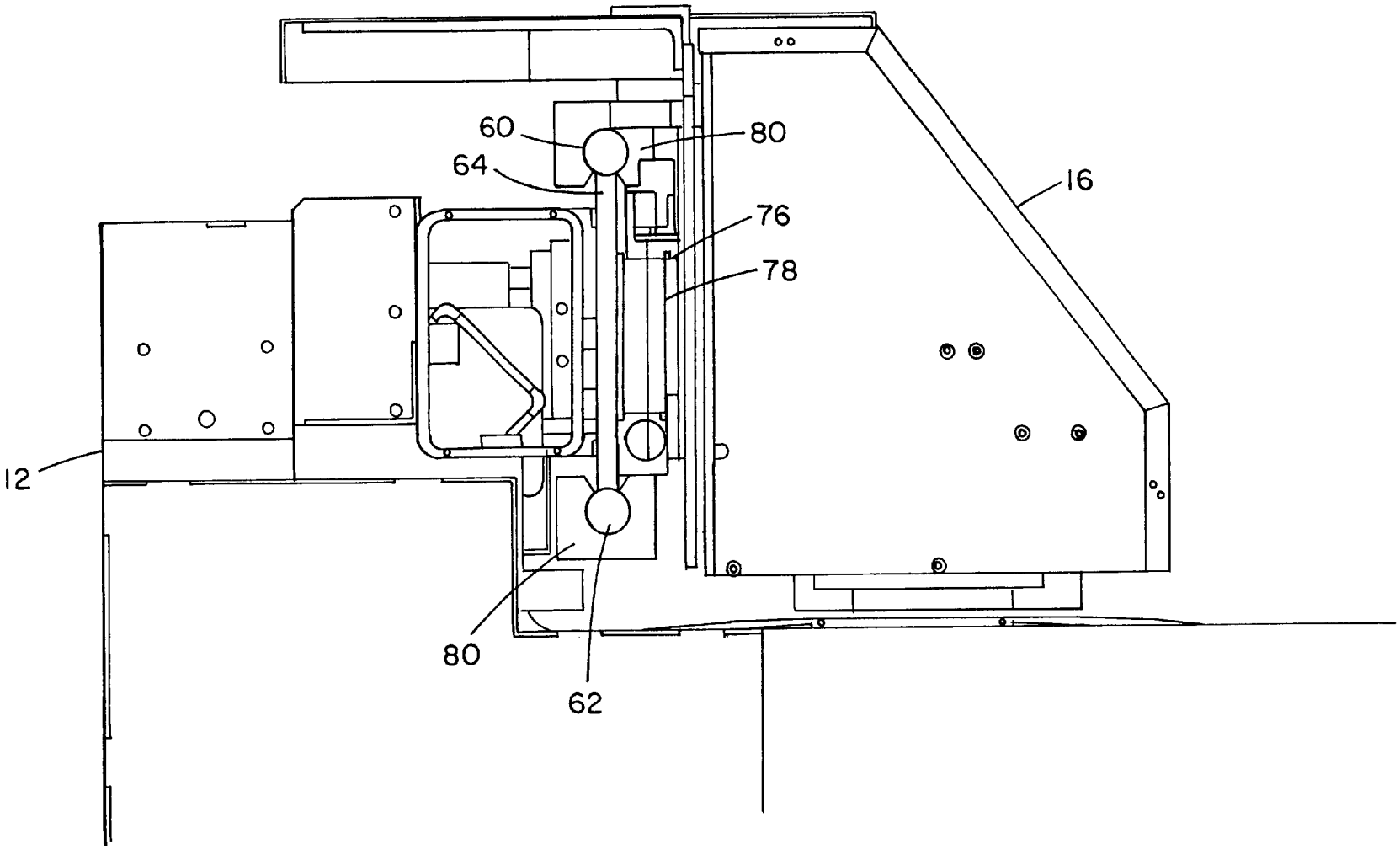
FIG. 4C is a cross-sectional view of the rail system of FIG. 4A shown with the carriage of the printing system.

Also shown in FIGS. 4B and 4C is a pulley 76 and a carriage belt 78 that is attached to the carriage 16. The pulley 76 and another similar pulley, one of which is connected to a motor, are located on either end of the rail system 14. Referring in particular to FIG. 4C, the carriage 16 is provided with a set of sleeve bushings 80 to enable the carriage to slide along rails 60 and 62. Accordingly, as the motor drives the pulley, the carriage 16 traverses partially or fully along the length of the rails 60 and 62.

In use, an operator activates the printer system 10 and places the substrate 32 onto the belt 18. As mentioned above, the vacuum sensor 40 detects the vacuum of the vacuum table 22 as applied to the substrate 32. This information is fed to the CPU 44 which controls the vacuum motor 42 to maintain the desired vacuum. Because porous sheet 43 acts as a flow resistor, large variations in the applied vacuum are not required. In fact, little or no variations in the applied vacuum are required in a typical printing process.

The drive motor 36 rotates the drive roller 24 to move the transport belt 18 and hence the substrate 32 under the print heads 17. Meanwhile, the dynamic tensioning device 29 of the idler roller 26 maintains a constant tension in the belt 18 during the printing operation. The translational movement of the substrate 32 underneath the print heads 17 is monitored by the encoder wheel 28 to ensure that this movement is precisely controlled.

As the substrate moves under the carriage 16 and hence the print heads 17, the carriage 16 traverses back and forth (that is, in and out of the page when referring to FIG. 2A) along the width of the substrate as instructed by the CPU 44, while the print heads 17 deposit ink onto the substrate to create the desired image. The ink can be, for example, solvent pigment inks, UV resistant inks, or water inks. The through put of printing system 10 ranges from about 0.5 ft/min to about 10 ft/min.

As discussed above, changes in the thickness of the substrate are automatically detected by the system. Thus, if a thin, flexible substrate is followed by a thicker, non-flexible substrate, the system automatically without the intervention of the operator adjusts the height of carriage 16 such that the proper gap is maintained between the print heads 17 and the substrate.

While this invention has been particularly shown and described with references to preferred embodiments thereof, it will be understood by those skilled in the art that various changes in form and details may be made therein without departing from the scope of the invention encompassed by the appended claims.

What is claimed is:

1. A system for printing images on a substrate, comprising:

a table adapted to support a substrate, including flexible and non-flexible substrates;

a multiplicity of print heads mounted in a carriage, the print heads being positioned a distance from the substrate;

a sensor which detects the thickness of the substrate as the substrate moves through the system; and a control system which receives the substrate thickness information detected by the sensor and transmits signals to a motor coupled to the carriage, the transmitted signals instructing the motor to adjust the position of the carriage to maintain a desired gap between the print heads and the substrate.

2. The system of claim 1, wherein the control system includes a controller which transmits the signals to the motor.

3. The system of claim 2, wherein the controller is coupled to a CPU which receives a substrate thickness information signal from the sensor, processes the information, and transmits signals to the controller to instruct the motor to adjust the position of the carriage to maintain the desired gap.

4. The system of claim of claim 2, wherein the control system includes a feedback device which senses the gap between the print heads and the substrate, the gap information being relayed to the controller such that the controller can further instruct the motor to alter the position of the print heads relative to the substrate to achieve the desired gap.

5. The system of claim 4, wherein the feedback device transmits the gap information to a CPU which process the information and relays the processed gap information to the controller.

6. The system of claim 1, wherein the motor is a servo motor.

7. The system of claim 1, wherein the minimum gap is about 0.04 inch.

8. The system of claim 6, wherein the maximum gap is about 0.08 inch.

9. The system of claim 1, wherein upon the sensor detecting the thickness of the substrate, the position of the carriage is adjusted in less than about five seconds.

10. The system of claim 1, wherein the sensor includes an indicator roller.

11. The system of claim 10, wherein the sensor includes a dial indicator coupled to the indicator roller.

12. A method for controlling the distance between print heads of a printing system and a substrate, comprising:

positioning a substrate on a table adapted to support flexible and non-flexible substrates;

moving the substrate relative to the print heads;

detecting the thickness of the substrate while the substrate moves relative to the print heads;

transmitting the thickness information to a controller;

transmitting height adjustment information signals from the controller to a motor coupled to a carriage which holds the print heads; and adjusting the position of the carriage with the motor to maintain a desired gap between the print heads and the substrate.

13. The method of claim 12, further comprising detecting the distance between the print heads and the substrate.

14. The method of claim 13, further comprising transmitting the distance information to the controller and re-adjusting the position of the print heads based on the distance information detected.

15. The method of claim 12, wherein adjusting maintains the desired gap in the range from about 0.04 inch to about 0.08 inch.

16. A method of printing on a plurality of substrates, including flexible and non-flexible substrates, comprising:

positioning a first substrate having a first thickness on a table, the first substrate comprising a first one of a flexible and non-flexible substrate;

moving the first substrate relative to the print heads;

detecting the thickness of the first substrate;

transmitting the thickness information to a controller;

transmitting height adjustment information signals from the controller to a motor coupled to a carriage which holds the print heads;

adjusting the position of the carriage with the motor to maintain a desired gap between the print heads and the substrate;

printing an image on the first substrate;

positioning a second substrate having a second thickness on the table, the second substrate comprising the second one of a flexible and non-flexible substrate;

moving the second substrate relative to the print heads;

detecting the thickness of the second substrate;

transmitting the thickness information to a controller;

transmitting height adjustment information signals from the controller to a motor coupled to a carriage which holds the print heads;

adjusting the position of the carriage with the motor to maintain a desired gap between the print heads and the second substrate, the gap substantially identical to the gap between the print heads and the first substrate; and printing an image on the second substrate.

17. The method of claim 16, wherein the steps of detecting the thicknesses of the substrates, transmitting height adjustment signals, and adjusting the position of the carriage are performed automatically with substantially no user intervention.

18. The method of claim 16, wherein the steps of detecting the thicknesses of the substrates, transmitting height adjustment signals, and adjusting the position of the carriage are all performed within about 5 seconds or less.

* * * * *

UNITED STATES PATENT AND TRADEMARK OFFICE

CERTIFICATE OF CORRECTION

PATENT NO. : 6,616,355 B2
DATED : September 9, 2003
INVENTOR(S) : Arthur L. Cleary et al.

It is certified that error appears in the above-identified patent and that said Letters Patent is hereby corrected as shown below:

Column 6,
Line 49, delete "claim of"

Signed and Sealed this

Thirtieth Day of December, 2003

JAMES E. ROGAN
*Director of the United States Patent and Trademark Office*